US009199353B2

(12) United States Patent
Ota et al.

(10) Patent No.: US 9,199,353 B2
(45) Date of Patent: Dec. 1, 2015

(54) POWER TOOL

(75) Inventors: Tomoyuki Ota, Anjo (JP); Masanori Furusawa, Anjo (JP); Ken Yamauchi, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 862 days.

(21) Appl. No.: 13/089,815

(22) Filed: Apr. 19, 2011

(65) Prior Publication Data

US 2011/0260414 A1 Oct. 27, 2011

(30) Foreign Application Priority Data

Apr. 23, 2010 (JP) ..... 2010-100363

(51) Int. Cl.
*B23B 31/02* (2006.01)
*B24B 23/02* (2006.01)
*B24B 45/00* (2006.01)

(52) U.S. Cl.
CPC ..... *B24B 23/02* (2013.01); *B24B 45/003* (2013.01); *Y10T 279/16* (2015.01); *Y10T 279/33* (2015.01); *Y10T 279/3406* (2015.01); *Y10T 279/3487* (2015.01)

(58) Field of Classification Search
CPC ..... B24B 23/02; B24B 45/003
USPC ..... 279/141, 143–145; 83/698.41, 665, 83/666; 451/357, 359, 356; 30/276, 347, 30/277.4, 288, 389
See application file for complete search history.

(56) References Cited

U.S. PATENT DOCUMENTS 4,343,214 A 8/1982 Schadlich
5,366,312 A 11/1994 Raines
5,676,680 A * 10/1997 Lim ..... 606/176

(Continued)

FOREIGN PATENT DOCUMENTS

EP 0 028 285 5/1981
EP 1 819 490 B1 2/2010

(Continued)

OTHER PUBLICATIONS

Oct. 4, 2013 Search Report issued in European Patent Application No. 11163478.8.

*Primary Examiner* — Eric A Gates
*Assistant Examiner* — Chwen-Wei Su
(74) *Attorney, Agent, or Firm* — Oliff PLC

(57) ABSTRACT

An effective technique is provided for rationally clamping and holding various kinds of tool bits which can be selectively replaced with each other and attached to the driving shaft, in a power tool The power tool includes a driving shaft 125 for driving a tool bit 109A or 109B which is arbitrarily selected from various kinds of tool bits, a first clamping element 133 provided on the driving shaft 125 and a second clamping element 135A, 135B provided separately from the driving shaft 125 and can be fixed to the driving shaft 125. The selected tool bit 109A, 109B is clamped and held between the first clamping element 133 and the second clamping element 135A, 135B. Various kinds of the tool bits 109A, 109B have holes 163, 167 formed according to the kind of the tool bit, and either one of the first clamping element 133 and the second clamping element 135A, 135B has various kinds of protruding engagement parts 149, 153 appropriate to the kind of the tool bit 109A, 109B and engaged with the holes 163, 167 formed according to the kind of the tool bit 109A, 109B.

3 Claims, 14 Drawing Sheets

(56) References Cited

U.S. PATENT DOCUMENTS

| | | | | |
|---|---|---|---|---|
| 5,839,196 | A * | 11/1998 | Trott | 30/339 |
| 6,796,888 | B2 | 9/2004 | Jasch | |
| 7,207,873 | B2 * | 4/2007 | Hesse et al. | 451/359 |
| 2008/0190259 | A1 | 8/2008 | Bohne | |
| 2009/0312761 | A1 * | 12/2009 | Boykin et al. | 606/82 |
| 2009/0312762 | A1 * | 12/2009 | Boykin | 606/82 |

FOREIGN PATENT DOCUMENTS

| | | |
|---|---|---|
| JP | A-2002-233972 | 8/2002 |
| WO | WO 2004/043269 | 5/2004 |

* cited by examiner

POWER TOOL

BACKGROUND OF THE INVENTION

1. Field of the Invention

The invention relates to a technique for holding a tool bit to a tip end of a driving shaft, or more particularly to a technique for selectively replacing various kinds of tool bits within a power tool.

2. Description of the Related Art

Japanese non-examined laid-open Patent Publication No. 2002-233972 and EP1819490 respectively disclose power tools which can be applied to various operations such as a cutting operation, a scraping operation or a grinding operation by selectively replacing different kinds of tool bits. Known power tool can perform such various operations by driving the tool bit to reciprocatingly swing around a driving shaft. According to this power tool, a selected tool bit is clamped and held between two clamping flanges. The tool bit clamped between the clamping flanges is prevented from moving in a circumferential direction, or locked against rotation, with respect to the clamping flanges. For this purpose, a fixing projection is formed on one of the clamping flanges and can be fitted into a projection receiving hole having a predetermined shape and formed in the tool bit.

In the above-described clamping-type holding structure, the fixing projection formed on the clamping flange and the projection receiving hole formed in the tool bit are formed to be appropriately engaged with each other. Therefore, if a projection receiving hole is not configured to correspond in shape or position to the fixing projection, a tool bit having such a projection receiving hole can not be attached to the clamping flange.

SUMMARY OF THE INVENTION

Accordingly, it is an object of the invention to provide an effective technique in a power tool for rationally clamping and holding various kinds of tool bits which can be selectively replaced with each other and attached to the driving shaft.

Above-described object can be achieved by the claimed invention. In a preferred embodiment according to the invention, a representative power tool includes a driving shaft for driving a tool bit which is arbitrarily selected from various kinds of tool bits, a first clamping element provided on the driving shaft and a second clamping element provided separately from the driving shaft. Further, the selected tool bit is clamped and held between the first and second clamping elements. Each of the various kinds of the tool bits has holes formed according to the kind of the tool bit. Either one of the first and second clamping elements has various kinds of protruding engagement parts which are appropriate to the kind of the tool bit and engaged with the holes formed according to the kind of the tool bit. Further, the "various kinds of tool bits" according to the invention widely include tool bits classified by manufacturer, or tool bits classified by function. The "holes" according to the invention are holes designed to hold the tool bit, and the position, shape and number of the holes are determined according to the kind of the tool bit. The "power tool" according to the invention typically represents a power tool which can perform various kinds of operations by driving the tool bit to reciprocatingly swing around the driving shaft, but it suitably includes a power tool which is only used for single operation, for example, a circular saw for performing a cutting operation by rotationally driving the tool bit.

According to the preferred aspect of the invention, with the construction in which either one of the first and second clamping elements has various kinds of protruding engagement parts which are appropriate to the kind of the tool bit and engaged with the holes formed according to the kind of the tool bit, various kinds of tool bits can be arbitrarily selected and clamped and held between the first and second clamping elements. The tool bit clamped between the first and second clamping elements is prevented from moving in the circumferential direction with respect to the clamping elements by engagement of the protruding engagement parts with the holes of the tool bit. As a result, the tool bit can reliably receive power from the driving shaft.

According to a further aspect of the invention, each of the protruding engagement parts is formed by a projection which extends from an axial end surface of either one of the first and second clamping elements in an axial direction. Further, the projection of the invention can have an appropriate shape such as a circular or rectangular shape in cross section, and the number of the projections can be arbitrarily determined.

According to a further aspect of the invention, the protruding engagement part is formed by a plurality of projections which are arranged in a circle on the axial end surface of either one of the first and second clamping elements. According to the invention, by provision of a construction in which the projections are arranged in a circle, a predetermined strength can be easily obtained.

According to a further aspect of the invention, the second clamping element is formed by various kinds of flange members appropriate to the kind of the tool bit and having protruding engagement parts which are engaged with the holes formed in the tool bit according to the kind of the tool bit. The tool bit is typically caused to reciprocatingly swing in a direction transverse to the axial direction of the driving shaft. The flange member is a disc-like member having a side in a direction transverse to the axial direction of the driving shaft. This side of the flange member is designed as a clamping surface for holding the tool bit, and the flange member receives the tool bit by friction of the clamping surface and engagement of the protruding engagement parts with the holes. Various kinds of flange members can be selectively used so that the power tool can easily adapt to various kinds of tool bits prepared.

According to a further embodiment of the invention, the second clamping element is formed by a flange member having protruding engagement parts which are formed on both end surfaces in the axial direction and engaged with the holes formed in the tool bit according to the kind of the tool bit. Further, the second clamping element can be reversed and attached to the driving shaft or the first clamping element such that a side of the second clamping element which has protruding engagement part appropriate to the kind of the selected tool bit is opposed to the first clamping element. By provision of a construction in which the both sides of the flange member can be used by reversing, the flange member is held attached to the first clamping member or the driving shaft except for replacement of the tool bit, so that loss of the flange member can be avoided.

According to a further aspect of the invention, the first clamping element is formed by a flange member having protruding engagement parts which are formed on both end surfaces in the axial direction and engaged with the holes formed in the tool bit according to the kind of the tool bit. Further, the first clamping element can be reversed and attached to the driving shaft such that a side of the first clamping element which has protruding engagement parts appropriate to the kind of the selected tool bit is opposed to the second clamping element. By provision of the construction in which the both sides of the flange member can be used by reversing, the flange member is held attached to the first clamping member or the driving shaft except for replacement of the tool bit, so that loss of the flange member can be avoided.

According to a further aspect of the invention, protruding engagement parts are formed on the second clamping member, and fixing holes configured to be appropriately engaged with the protruding engagement parts are formed in the first clamping member. When the tool bit is clamped between the first and second clamping elements, ends of the protruding engagement parts engaged with the holes of the tool bit are fitted into the fixing holes, so that the first and second clamping elements are prevented from rotating around an axis of the driving shaft with respect to each other. Various kinds of the tool bits can be selectively clamped and held, and the second clamping member can be securely fixed to the first clamping member in the circumferential direction. Such a construction is effective in the power tool designed to drive the tool bit to reciprocatingly swing.

According to a further aspect of the invention, various kinds of the fixing holes in the first clamping element are formed on the same plane.

According to a further aspect of the invention, each of the various kinds of the tool bits has an opening in its center. Further, the first clamping element has a shaft part which has a noncircular cross section and extends toward the second clamping element through an opening of the tool bit when the selected tool bit is clamped by the first and second clamping elements. Further, the second clamping element has a through hole which has the same noncircular shape as the cross section of the shaft part and is fitted onto the shaft part so that the second clamping element is positioned with respect to the first clamping element in the circumferential direction. The "noncircular shaft part" and the "noncircular through hole" according to the invention typically represent a shaft part having a width across bolt and an elliptical hole shaped to be engaged with the shaft part, respectively, but they may have a rectangular shape. When the tool bit is clamped and held, the second clamping member can be easily positioned with respect to the first clamping member, so that replacement of the tool bit can be easily made.

Further, according to another aspect of the invention, an attachment for fixing an arbitrarily selected one of various kinds of tool bits to a driving shaft of a power tool is provided. The attachment has a first clamping element that is attached to the driving shaft and a second clamping element that is provided separately from the driving shaft. The attachment is configured to fixedly clamp the selected tool bit between the first and second clamping elements. Each of the various kinds of the tool bits has holes fainted according to the kind of the tool bit. Either one of the first and second clamping elements has various kinds of protruding engagement parts which are appropriate to the kind of the tool bit and engaged with the holes formed according to the kind of the tool bit. An arbitrarily selected one of various kinds of the tool bits can be fixed to the driving shaft of the power tool by using the attachment constructed as described above.

Effect of the Invention

According to the invention, an effective technique for rationally clamping and holding various kinds of tool bits which can be selectively replaced with each other and attached to the driving shaft is provided in a power tool. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tool and method for using such power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
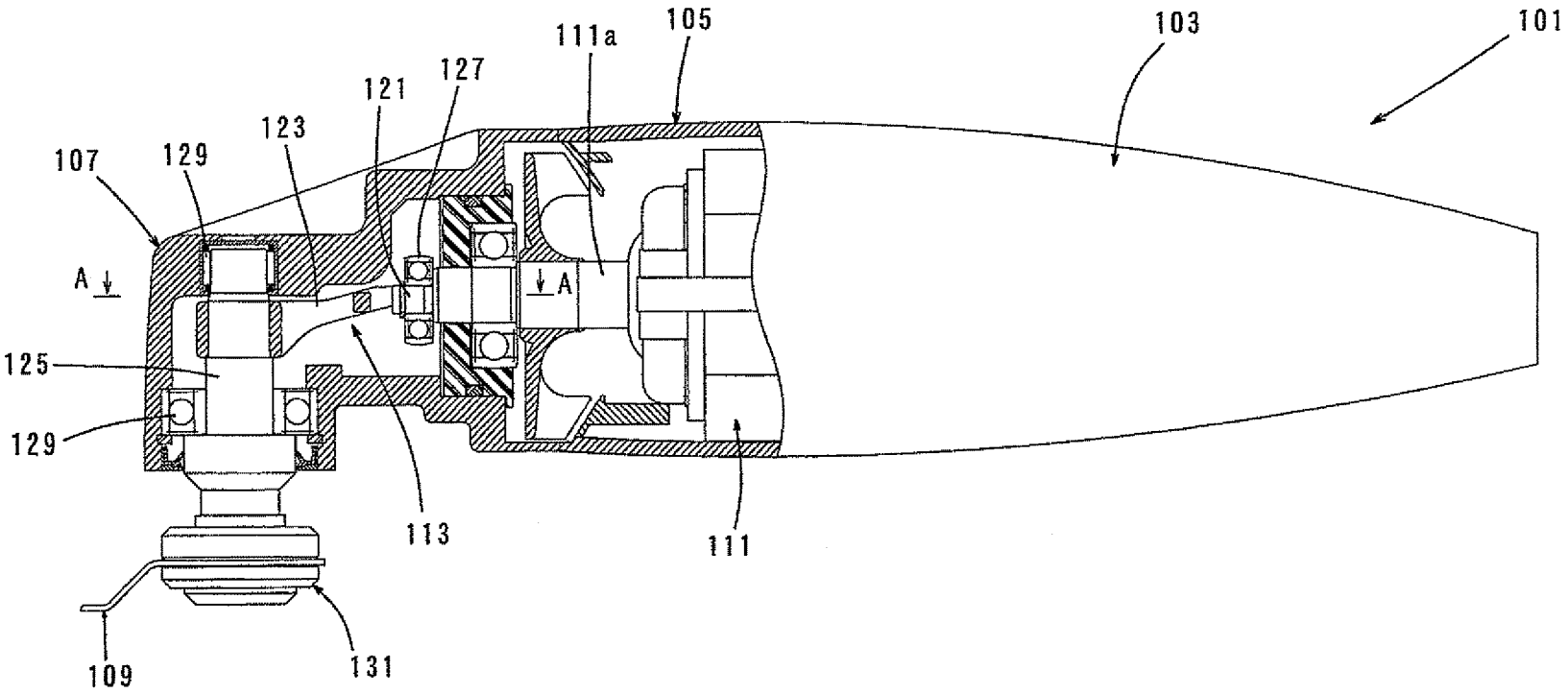
FIG. 1 is a sectional side view showing an entire power tool according to a first embodiment of the invention.

An embodiment of the invention is now described with reference to FIGS. 1 to 14. In this embodiment, an electric power tool (hereinafter referred to as a multi-tool) is explained as a representative example of a power tool according to the invention. The multi-tool 101 can be applied to various operations such as a cutting operation, a scraping operation or a grinding operation by selectively replacing various kinds of tool bits. As shown in FIG. 1, the multi-tool 101 mainly includes a tool body in the form of a body 103 that forms an outer shell of the multi-tool 101 and a tool bit 109 attached to a front end region of the body 103 via a tool holder 131. The body 103 mainly includes a motor housing 105 and a mechanical housing 107 connected to one end of the motor housing 105. The tool bit 109 is a feature that corresponds to the "tool bit" according to the invention. Further, for the sake of convenience of explanation, the side of the tool bit 109 in a longitudinal direction of the body 103 is taken as the front and its opposite side as the rear.

The motor housing 105 is generally cylindrically shaped and houses a driving motor 111. The driving motor 111 is disposed such that its rotational axis extends in a direction transverse to the longitudinal direction of the tool bit 109. Further, the driving motor 111 is driven when a user operates a motor driving switch (not shown) disposed on the motor housing 105. The mechanical housing 107 connected to the front end of the motor housing 105 houses a motion converting mechanism 113 which converts rotating output of the driving motor 111 into reciprocating swinging movement in the horizontal direction and then transmits it to the tool bit 109.

Figure 2:
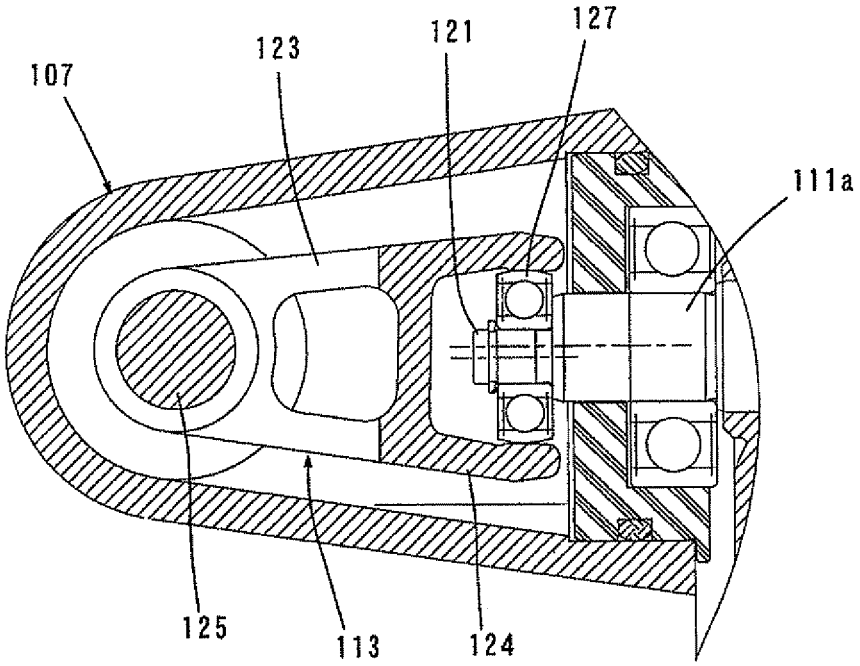
FIG. 2 is a sectional view taken along line A-A in FIG. 1.

As shown in FIGS. 1 and 2, the motion converting mechanism 113 mainly includes an eccentric shaft 121 provided on a front end of a motor output shaft 111*a* of the driving motor 111, a swing arm 123 which is caused to swing by the eccentric shaft 121, and a driving shaft 125 which forms the center of swinging motion of the swing arm 123 and to which the tool bit 119 is attached. The eccentric shaft 121 is disposed in an eccentric position displaced a predetermined distance from the rotational axis of the motor output shaft 111*a* in a radial direction. Further, the eccentric shaft 121 is caused to revolve around the rotational axis of the motor output shaft 111*a* when the driving motor 111 is driven.

The swing arm 123 extends in an axial direction of the motor output shaft 111*a*. One end (front end) of the swing arm 123 in its extending direction is fixed to the driving shaft 125 and the other end has a bifurcated engagement part 124. The engagement part 124 is engaged with a bearing 127 attached to the eccentric shaft 121 in such a manner as to hold an outer ring of the bearing 127 from outside. Therefore, when the eccentric shaft 121 revolves, the swing arm 123 is caused to horizontally reciprocate or swing on the center of the axis of the driving shaft 125.

The driving shaft 125 is disposed such that its longitudinal direction is perpendicular to the rotational axis of the motor output shaft 111*a*, and is rotatably supported to the mechanical housing 107 by a bearing 129. Further, one axial end of the driving shaft 125 protrudes to the outside (downward) from a lower surface of the mechanical housing 107, and the tool holder 131 which forms a tool holding part for holding the tool bit 109 is provided on the tip of the driving shaft 125. The tool bit 109 which can be replaced and attached to the tool holder 131 to be used for various kinds of operations includes a cutting saw blade for use in cutting operation, a scraper for use in paint scraping operation or a paper holding pad for use in grinding or polishing operation on a workpiece.

In the multi-tool 101 constructed as described above, when the user holds an outer surface of the motor housing 105 with one or both hands and operates a switch knob (not shown) to drive the driving motor 111 in order to perform an operation, the driving shaft 125 is caused to reciprocatingly rotate at high speed together with the swing arm 123 engaged with the eccentric shaft 121 which revolves around the center of the motor output shaft 111*a*. Therefore, the tool bit 109 fixed to the tip of the driving shaft 125 via the tool holder 131 is caused to reciprocatingly swing on the center of the axis of the driving shaft 125. Thus, a predetermined operation can be performed on a workpiece by reciprocating swinging movement of the tool bit 109 around the driving shaft 125.

In the multi-tool 101 constructed as described above, the tool holder 131 for holding the tool bit 109 to the driving shaft 125 is now explained with reference to FIGS. 3 to 14. The tool holder 131 is a feature that corresponds to the "attachment" according to the invention. The shape of a hole which is formed in the tool bit 109 in order to hold the tool bit 109 to the tool holder 131 may vary among manufacturers or functions (operations). Therefore, in the multi-tool 101 according to this embodiment, the tool holder 131 is improved such that various kinds (two kinds in this embodiment) of the tool bits 109 which have holes varying in shape by the kind of the tool bit can be selectively replaced with each other.

In the tool holder 131 according to this embodiment, the tool bit 109 is clamped and held between two opposed flange members. The tool holder 131 includes one (body-side) clamping member in the form of an inner flange member 133 which is fixed to the driving shaft 125, the other (tool-side) clamping member in the form of outer flange members 135A, 135B which are separately formed from the driving shaft 125, and a flanged fixing screw 137 for fixing the outer flange member 135A or 135B to the driving shaft 125. The inner flange member 133 and the outer flange member 135 are features that correspond to the "first clamping element" and the "second clamping element", respectively, according to the invention.

Figure 9:
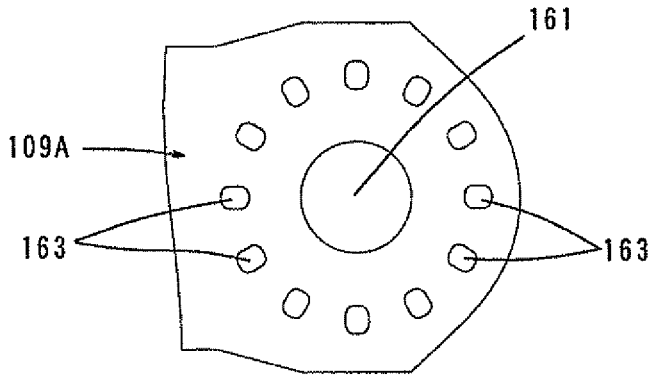
FIG. 9 is a plan view showing a tool bit.
Figure 10:
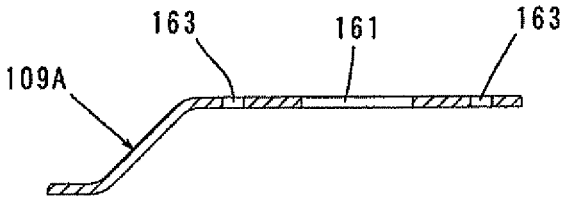
FIG. 10 is a sectional view showing the tool bit.
Figure 11:
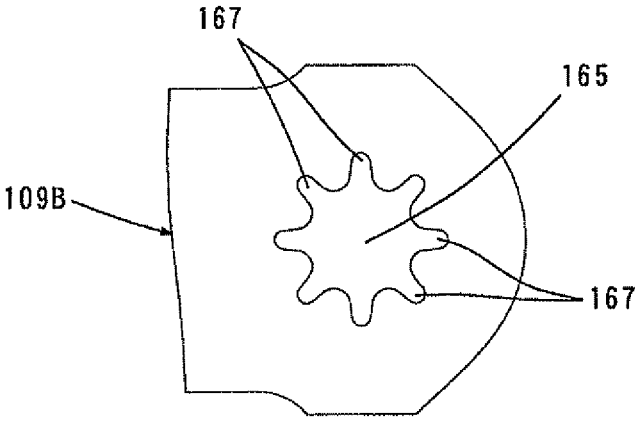
FIG. 11 is a plan view showing the other tool bit.
Figure 12:
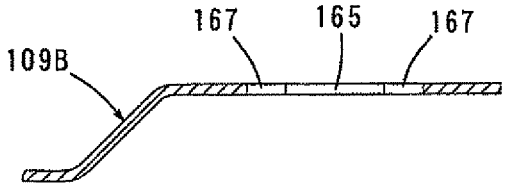
FIG. 12 is a sectional view showing the other tool bit.

Further, the tool bit 109 which is clamped and held by the inner flange member 133 and the outer flange member 135A or 135B of the tool holder 131, is formed, for example, by a plate-like member having a generally rectangular or sectorial shape. As shown in FIGS. 9 and 10, one tool bit 109A (hereinafter referred to as a first tool bit) of one of the various kinds (two kinds) has a circular hole 161 and a number of small holes (group of small holes) 163 in a region to be clamped by the tool holder 131. The small holes 163 are arranged with equal spacing in a circle around the circular hole 161. Further, as shown in FIGS. 11 and 12, the other tool bit 109B (hereinafter referred to as a second tool bit) has a circular hole 165 and a number of cutout holes 167. The cutout holes 167 extend radially outward from the circular hole 165 with a predetermined length and are arranged with equal spacing in the circumferential direction. Each of the cutout holes 167 has a curved tip end and a curved connection with the circular hole 165. The small holes 163 of the first tool bit 109A are arranged in a concentric circle having a different radius from a circle in which the cutout holes 167 of the second tool bit 109B are arranged. In this embodiment, the small holes 163 are arranged in a radially outer region of the first tool bit 109A and the cutout holes 167 are arranged in a radially inner region of the second tool bit 109B. The small holes 163 and the cutout holes 167 of the first and second tool bits 109A, 109B are provided in order to fix the first and second tool bits 109A, 109B and are features that correspond to the "holes formed according to the kind of the tool bit" according to the invention. Further, the circular holes 161, 165 are features that correspond to the "opening" according to the invention.

Figure 5:
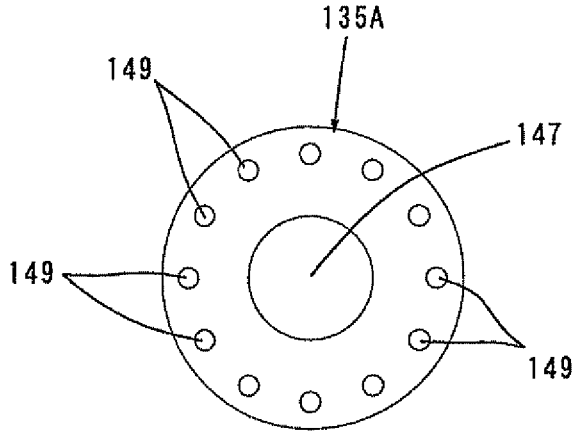
FIG. 5 is a plan view showing an outer flange member of the tool holder.
Figure 6:
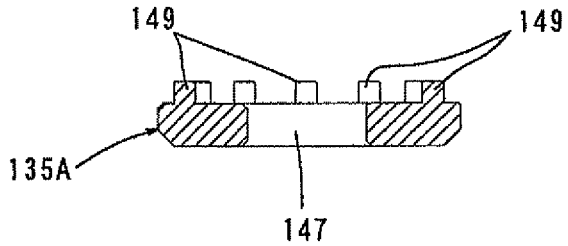
FIG. 6 is a sectional view showing the outer flange member.

Each of the outer flange members 135A, 135B of various kinds is formed by a disc-like member which is detachable from the driving shaft 125. As shown in FIGS. 5 and 6, a circular mounting hole 147 is centrally formed in the outer flange member 135A for holding the first tool bit 109A and the fixing screw 137 is inserted through the mounting hole 147. Further, one end surface of the outer flange member 135A in the axial direction is designed as a clamping surface which holds the tool bit in contact with the outer surface of the tool bit. A number of engagement pins 149 are formed on this end surface and protrude in parallel in the axial direction. The engagement pins 149 are formed to be appropriately engaged with the small holes 163 of the first tool bit 109A and are arranged with equal spacing in a circle around the mounting hole 147. Specifically, the engagement pins 149 are arranged around the mounting hole 147 with the same spacing as the small holes 163 and in a circle having the same radius as a circle in which the small holes 163 of the first tool bit 109A are arranged.

Figure 7:
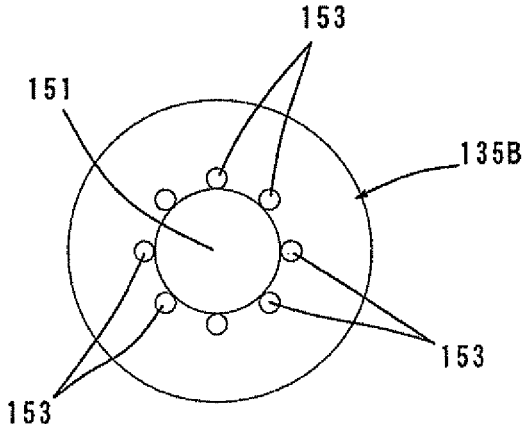
FIG. 7 is a plan view showing the other outer flange member of the tool holder.
Figure 8:
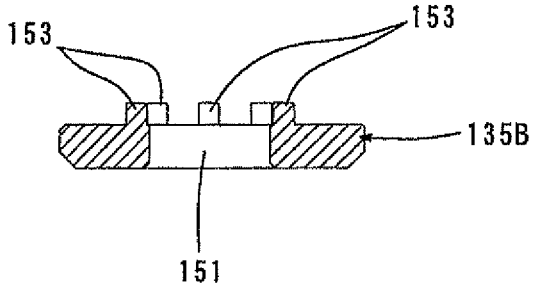
FIG. 8 is a sectional view showing the other outer flange member.

Similarly, as shown in FIGS. 7 and 8, a circular mounting hole 151 is centrally formed in the outer flange member 135B for holding the second tool bit 109B and the fixing screw 137 is inserted through the mounting hole 151. One end surface of the outer flange member 135B in the axial direction is designed as a clamping surface which holds the tool bit in contact with the outer surface of the tool bit. A number of engagement pins 153 are formed on this end surface and protrude in parallel in the axial direction. The engagement pins 153 are formed to be appropriately engaged with the cutout holes 167 of the second tool bit 109B and are arranged with equal spacing in a circle around the mounting hole 151. Specifically, the engagement pins 153 are arranged around the mounting hole 151 with the same spacing as the cutout holes 167 and in a circle having the same radius as a circle in which the cutout holes 167 of the second tool bit 109B are arranged. Therefore, the engagement pins 149 are arranged in a radially outer region of the outer flange member 135A for the first tool bit and the engagement pins 153 are arranged in a radially inner region of the outer flange member 135B for the second tool bit. Each of the engagement pins 149, 153 is a feature that corresponds to the "protruding engagement part" and the "projection" according to the invention.

An axially extending threaded hole 125*a* is formed through the center of the axis of the driving shaft 125. Each of the outer flange members 135A, 135B constructed as described above is fixed when its (outer) surface facing away from the tool bit 109A or 109B is pressed by a flange 137*a* of the fixing screw 137 which is screwed into the threaded hole 125*a* of the driving shaft 125 (see FIGS. 13 and 14).

Figure 3:
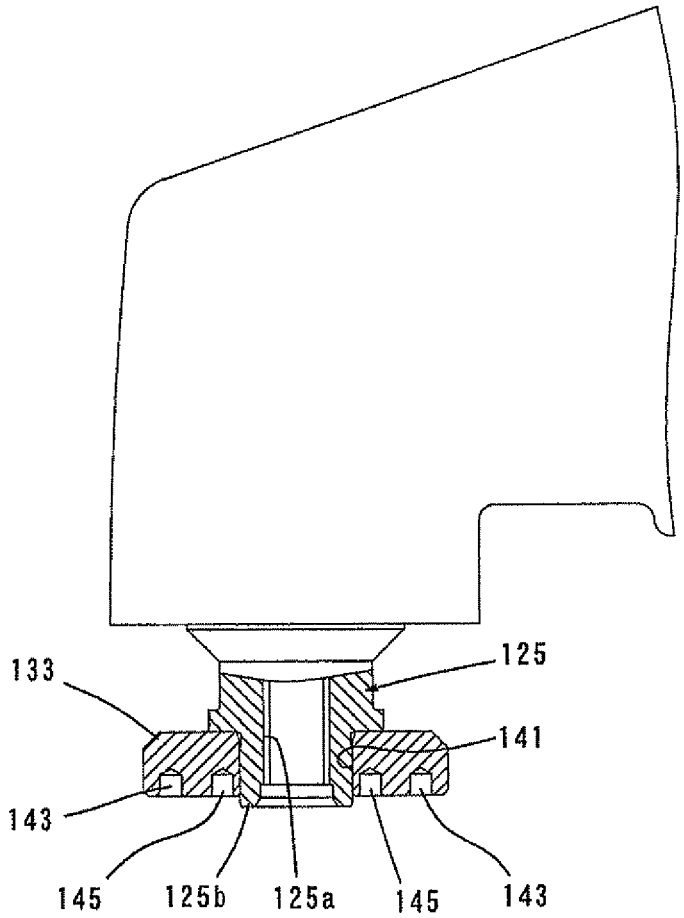
FIG. 3 is a sectional view showing an inner flange member of a tool holder according to the first embodiment.
Figure 4:
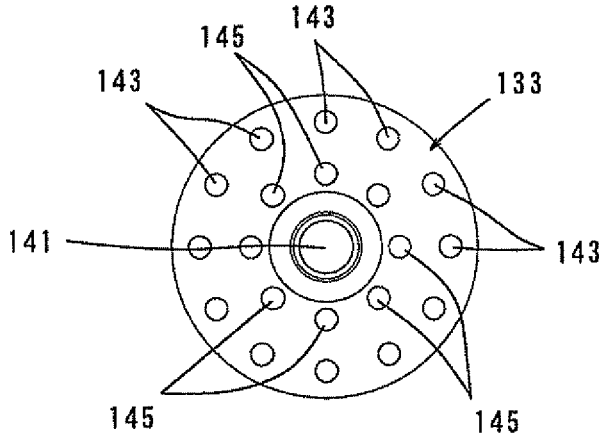
FIG. 4 is a view (bottom view) showing the inner flange member as viewed from below.

As shown in FIGS. 3 and 4, the inner flange member 133 is a disc-like member having a circular mounting hole 141 in its center. A mounting shaft part 125*b* having a smaller diameter is formed on the tip end of the driving shaft 125 and is fitted into the mounting hole 141 so that the inner flange member 133 is mounted to the driving shaft 125. A number of circular holes 143, 145 each having a bottom are formed in one end surface of the inner flange member 133 in the axial direction or a clamping surface which holds the tool bit in contact with the outer surface of the tool bit. The circular holes 143, 145 are arranged in two concentric circles having different radiuses around the center of the mounting hole on the same plane, and arranged with equal spacing in the circumferential direction. The circular holes 143 are arranged in a radially outer region and formed to be appropriately engaged with the engagement pins 149 on the outer flange member 135A, and the circular holes 145 are arranged in a radially inner region and formed to be appropriately engaged with the engagement pins 153 on the other outer flange member 135B. Specifically, when the tip ends of the engagement pins 149 or 153 are inserted into the circular holes 143 or 145 in order to fix the tool bit 109A or 109B, the outer flange member 135A or 135B is prevented from moving in the circumferential direction with respect to the inner flange member 133. The circular holes 143, 145 are features that correspond to the "fixing holes" according to the invention.

Figure 13:
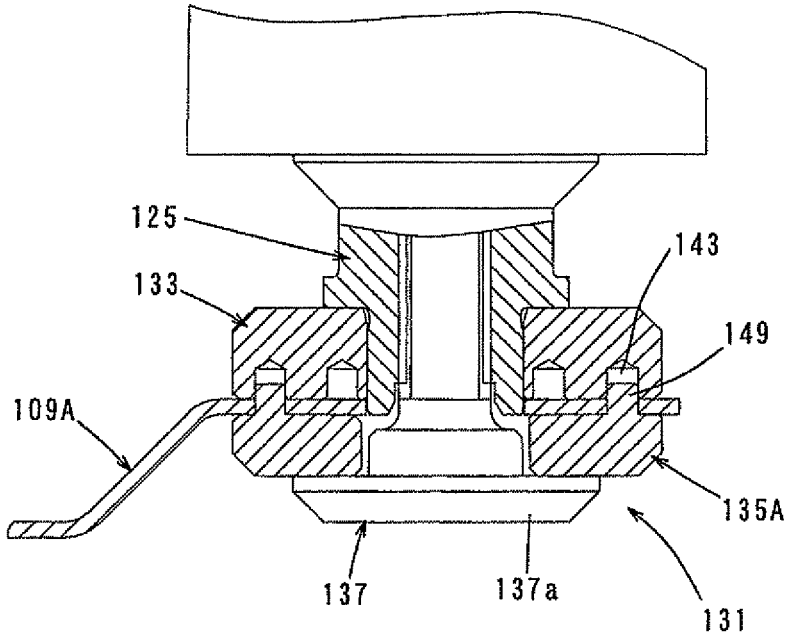
FIG. 13 is a sectional view showing the state in which the tool bit is clamped and held to the tool holder.

The tool holder 131 according to this embodiment is constructed as described above. FIG. 13 shows the state in which the first tool bit 109A is fixed to the tool holder 131. The first tool bit 109A is clamped and held between the inner flange member 133 and the outer flange member 135A. In this state, the engagement pins 149 of the outer flange member 135A are inserted through the associated small holes 163 of the first tool bit 109A, and the tip ends of the engagement pins 149 protrude through the small holes 163 and are fitted into the associated circular holes 143 formed in the radially outer region of the inner flange member 133. In this manner, the first tool bit 109A is securely fixed to the tool holder 131 such that it is prevented from moving in the circumferential direction with respect to the tool holder 131.

Figure 14:
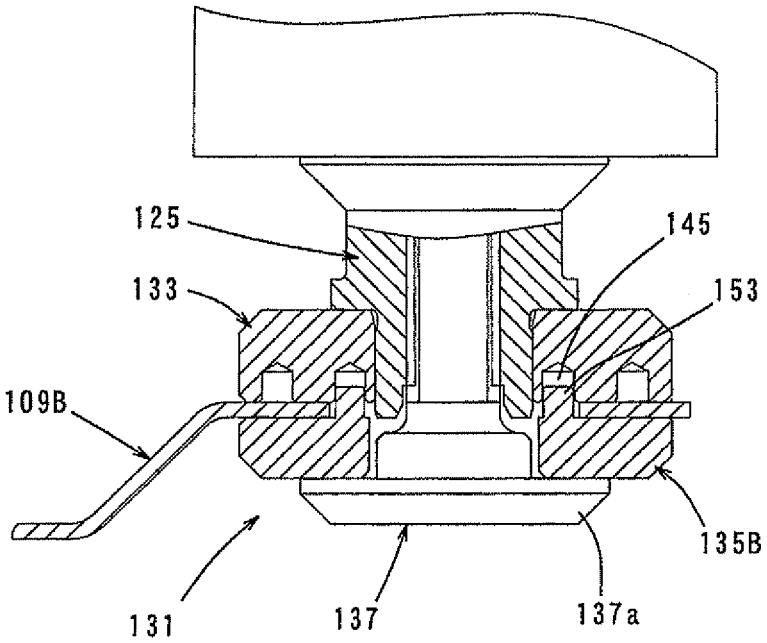
FIG. 14 is a sectional view showing the state in which the other tool bit is clamped and held to the tool holder.

In order to replace the first tool bit 109A with the second tool bit 109B, firstly, the fixing screw 137 is removed from the driving shaft 125 and then the outer flange member 135A and the first tool bit 109A are removed. Thereafter, the second tool bit 109B is placed on the inner flange member 133 and further the outer flange member 135B is placed on top of the second tool bit 109B. In this state, the fixing screw 137 is screwed into the threaded hole of the driving shaft, so that the second tool bit 109B can be attached to the tool holder 131. FIG. 14 shows the state in which the second tool bit 109B is fixed to the tool holder 131. When the second tool bit 109B is clamped and fixed, the engagement pins 153 of the outer flange member 135B are engaged with the associated the cutout holes 167 of the second tool bit 109B, and the tip ends of the engagement pins 153 protrude through the cutout holes 167 and are inserted into the associated circular holes 145 formed in the radially inner region of the inner flange member 133. In this manner, the first tool bit 109B is securely fixed to the tool holder 131 such that it is prevented from moving in the circumferential direction with respect to the tool holder 131.

Thus, according to this embodiment, by provision of two kinds of the outer flange members, or the outer flange member 135A having the engagement pins 149 which can be appropriately engaged with the small holes 163 of the first tool bit 109A and the outer flange member 135B having the engagement pins 153 which can be appropriately engaged with the cutout holes 167 of the second tool bit 109B, the tool bit 109A or 109B can be replaced by selectively using the outer flange member 135A or 135B for the tool bit 109A or 109B.

In this embodiment, a plurality of the outer flange members 135A, 135B are prepared to be appropriately engaged with the differently shaped holes of the tool bits 109A, 109B of various kinds, and replacement of the tool bits can be made by using the outer flange member appropriate to the shape of the holes of the tool bit to be fixed. Therefore, even if the tool bits are classified into two or more kinds, by provision of the same number of the outer flange members as the number of the kinds of the tool bits, replacement of two or more kinds of tool bits can be realized.

Second Embodiment of the Invention

Figure 15:
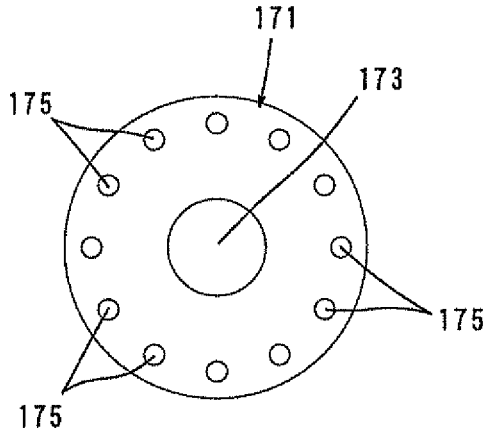
FIG. 15 is a plan view showing an outer flange member of a tool holder according to a second embodiment.
Figure 16:
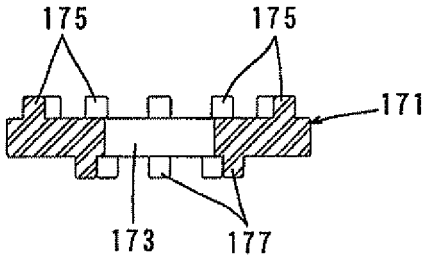
FIG. 16 is a sectional view showing the outer flange member.
Figure 17:
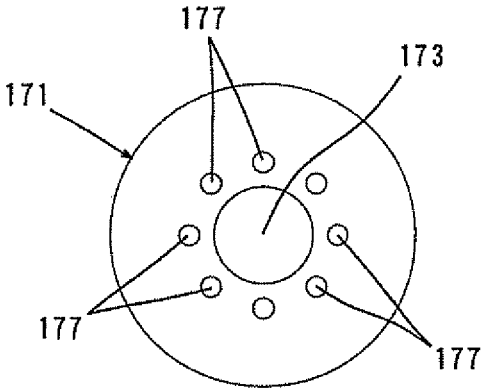
FIG. 17 is a bottom view showing the outer flange member.

The second embodiment of the invention is now explained with reference to FIGS. 15 to 19. This embodiment is a modification of the tool holder 131 and constructed such that an outer flange member 171 corresponding to the "second clamping element" in the invention can be reversed in use. Therefore, in this embodiment, as shown in FIGS. 15 to 17, the outer flange member 171 has a circular mounting hole 173 in its center. Further, a number of engagement pins 175 for engagement with the small holes 163 of the first tool bit 109A are formed on one end surface (front side) of the outer flange member 171 in the axial direction and protrude in parallel in the axial direction, and a number of engagement pins 177 for engagement with the cutout holes 167 of the second tool bit 109B are formed in the other end surface (back side) in the axial direction and protrude in parallel in the axial direction.

As shown in FIG. 15, the engagement pins 175 provided on the front side for the first tool bit are arranged in a circle around the mounting hole 173. Specifically, the engagement pins 175 are arranged with the same spacing as the small holes 163 and in a circle having the same radius as a circle in which the small holes 163 of the first tool bit 109A are arranged. Further, as shown in FIG. 17, the engagement pins 177 provided on the back side for the second tool bit are arranged in a circle around the mounting hole 173. Specifically, the engagement pins 177 are arranged with the same spacing as the cutout holes 167 and in a circle having the same radius as a circle in which the cutout holes 167 of the second tool bit 109B are arranged. Therefore, the engagement pins 175 for the first tool bit are arranged in a radially outer region of the outer flange member 171, and the engagement pins 177 for the second tool bit are arranged in a radially inner region of the outer flange member 171. Each of the engagement pins 175, 177 is a feature that corresponds to the "protruding engagement part" and the "projection" according to the invention.

The outer flange member 171 is pressed and fixed by a flange 179*a* of a fixing screw 179 which is screwed into the threaded hole 125*a* of the driving shaft 125. In order to avoid the flange 179*a* of the fixing screw 179 from interfering with the engagement pins 175, 177 during this pressing and fixing, the outer diameter of the flange 179*a* of the fixing screw 179 is determined such that the flange 179*a* is located inside a circle in which the engagement pins 175 for the first tool bit are arranged. Further, in order to avoid interference with the engagement pins 177 for the second tool bit, an escape recess 179*b* is formed in a pressing surface of the fixing screw 179 which faces the outer flange member 171. In the other points, this embodiment has the same construction as the above-described first embodiment. Therefore its components are given like numerals and not described.

Figure 18:
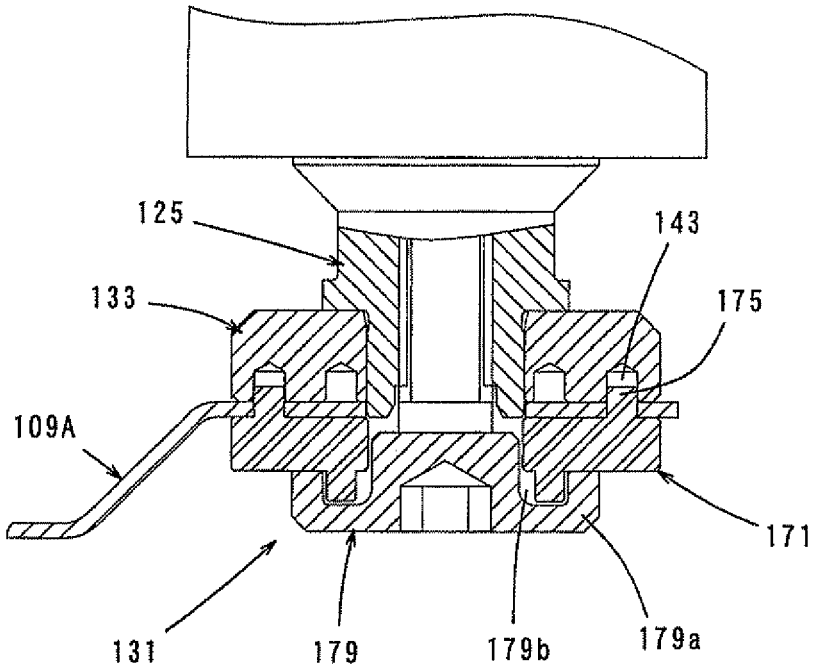
FIG. 18 is a sectional view showing the state in which the tool bit is clamped and held to the tool holder.
Figure 19:
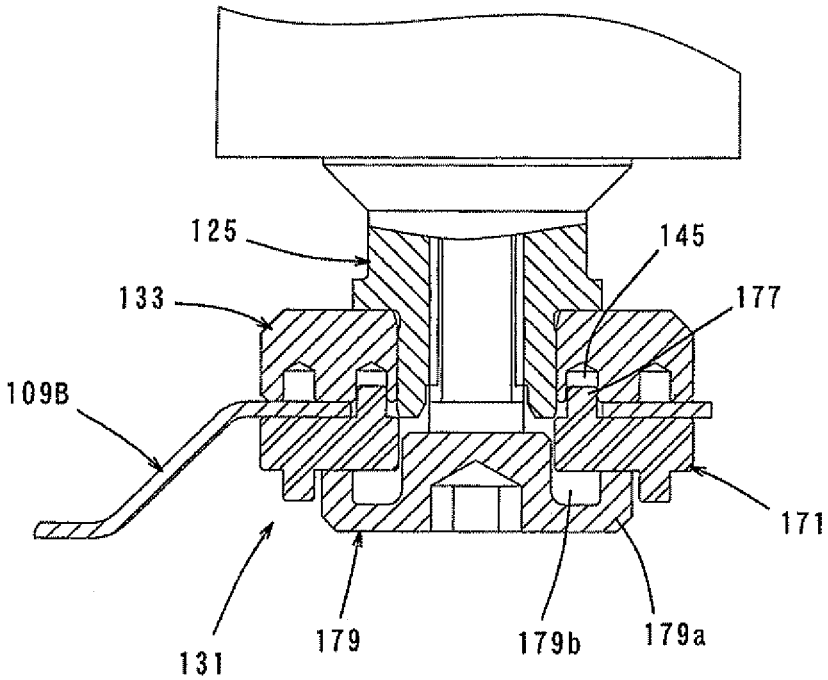
FIG. 19 is a sectional view showing the state in which the other tool bit is clamped and held to the tool holder.

According to the tool holder 131 of this embodiment which is constructed as described above, the outer flange member 171 can be reversed such that the first tool bit 109A and the second tool bit 109B can be selectively replaced with each other. FIG. 18 shows the state in which the first tool bit 109A is clamped and held between the inner flange member 133 and the outer flange member 171, and FIG. 19 shows the state in which the second tool bit 109B is clamped and held therebetween. The inner flange member 133 is a feature that corresponds to the "first clamping element" according to the invention.

When the first tool bit 109A is clamped and held, the engagement pins 175 which are provided on the front side of the outer flange member 171 and arranged in a radially outer region of the outer flange member 171 are inserted through the small holes 163 of the first tool bit 109A and fitted into the circular holes 143 which are arranged in a radially outer region of the inner flange member 133. In this manner, the first tool bit 109A is securely held to the tool holder 131 such that it is prevented from moving in the circumferential direction with respect to the tool holder 131. Further, when the second tool bit 109B is clamped and held, the engagement pins 177 which are provided on the back side of the outer flange member 171 and arranged in a radially inner region of the outer flange member 171, are inserted through the cutout holes 167 of the second tool bit 109B and fitted into the circular holes 145 which are arranged in a radially inner region of the inner flange member 133. In this manner, the second tool bit 109B is securely held to the tool holder 131 such that it is prevented from moving in the circumferential direction with respect to the tool holder 131.

Further, in this embodiment, with the construction in which the front and back sides of the outer flange member 171 can be used by reversing, the outer flange member 171 is held attached to the body 103 side of the multi-tool 101 except for replacement, so that loss of the outer flange member can be avoided.

Third Embodiment of the Invention

Figure 20:
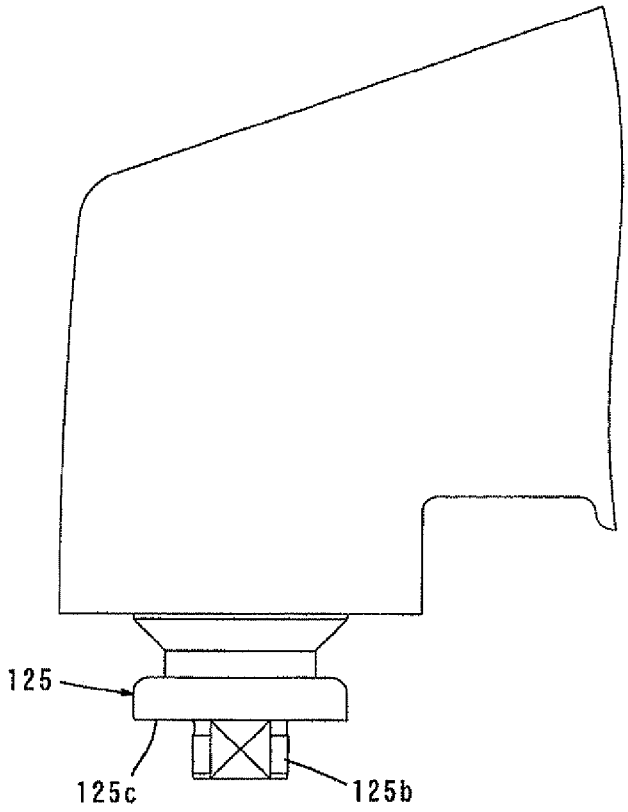
FIG. 20 is a side view showing a driving shaft according to a third embodiment.
Figure 21:
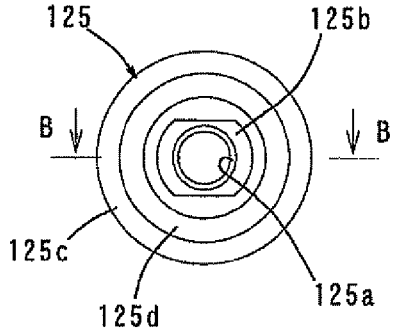
FIG. 21 is a bottom view showing the driving shaft.
Figure 22:
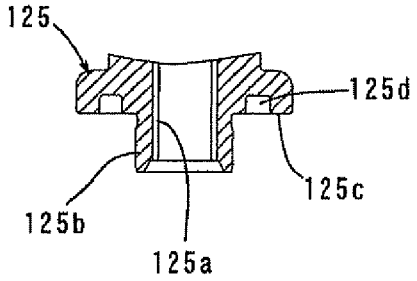
FIG. 22 is a sectional view taken along line B-B in FIG. 21.

The third embodiment of the invention is now explained with reference to FIGS. 20 to 27. This embodiment is a modification of the tool holder 131 and constructed such that an inner flange member 181 corresponding to the "first clamping element" in the invention can be reversed in use. Therefore, in this embodiment, the inner flange member 181 is detachably fitted into the smaller-diameter mounting shaft part 125*b* formed on the tip end of the driving shaft 125. As shown in FIGS. 20 to 22, a seating surface 125*c* for receiving an axial end surface of the inner flange member 181 and the mounting shaft part 125*b* protruding from the seating surface 125*c* are formed on the end of the driving shaft part 125. The mounting shaft part 125*b* has a generally elliptical cross section having a width across bolt.

Figure 23:
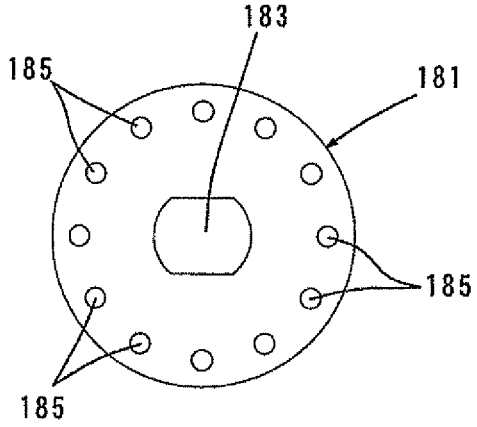
FIG. 23 is a plan view showing an inner flange member of the tool holder according to the third embodiment.
Figure 24:
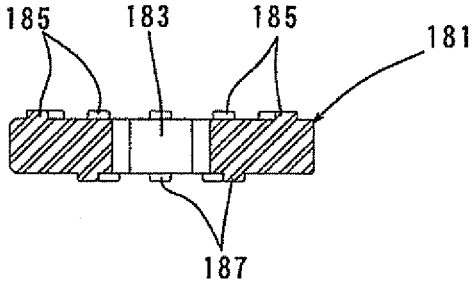
FIG. 24 is a sectional view showing the inner flange member.
Figure 25:
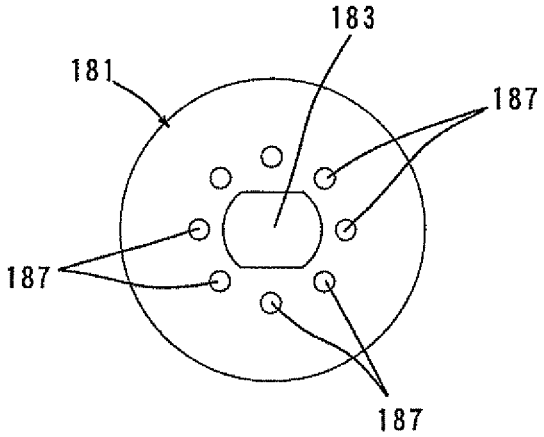
FIG. 25 is a bottom view showing the inner flange member.

As shown in FIGS. 23 to 25, the inner flange member 181 has a generally elliptical mounting hole 183 in its center. The mounting hole 183 is fitted onto the mounting shaft part 125*b* of the driving shaft 125 having an elliptical cross section. Thus, the inner flange member 181 is received by the seating surface 125*c* of the driving shaft 125 such that it is prevented from moving in the circumferential direction with respect to the driving shaft 125. Specifically, the inner flange member 181 is integrated with the driving shaft 125 in the circumferential direction. A number of engagement pins 185 for engagement with the small holes 163 of the first tool bit 109A are formed on one end surface (front side) of the inner flange member 181 in the axial direction and arranged in a circle with equal spacing in the circumferential direction. Further, a number of engagement pins 187 for engagement with the cutout holes 167 of the second tool bit 109B are formed on the other end surface (back side) in the axial direction and arranged in a circle with equal spacing in the circumferential direction.

As shown in FIG. 23, the front-side engagement pins 185 for the first tool bit are arranged in a circle around the mounting hole 183. Specifically, the engagement pins 185 are arranged with the same spacing as the small holes 163 and in a circle having the same radius as a circle in which the small holes 163 of the first tool bit 109A are arranged. As shown in FIG. 25, the back-side engagement pins 187 for the second tool bit are arranged in a circle so as to surround the mounting hole 183. Specifically, the engagement pins 187 are arranged with the same spacing as the cutout holes 167 and in a circle having the same radius as a circle in which the cutout holes 167 of the second tool bit 109B are arranged. Therefore, the engagement pins 185 for the first tool bit are arranged in a radially outer region of the inner flange member 181, and the engagement pins 187 for the second tool bit are arranged in a radially inner region of the inner flange member 181. Each of the engagement pins 185, 187 is a feature that corresponds to the "protruding engagement part" and the "projection" according to the invention. An outer flange member 189 is formed by a head of a fixing screw which is designed to also serve as a flange and is fastened to the driving shaft 125 by screwing a threaded part 189*a* of the outer flange member 189 into a threaded hole 125*a* of the driving shaft 125. The outer flange member 189 is a feature that corresponds to the "second clamping element" according to the invention.

Figure 26:
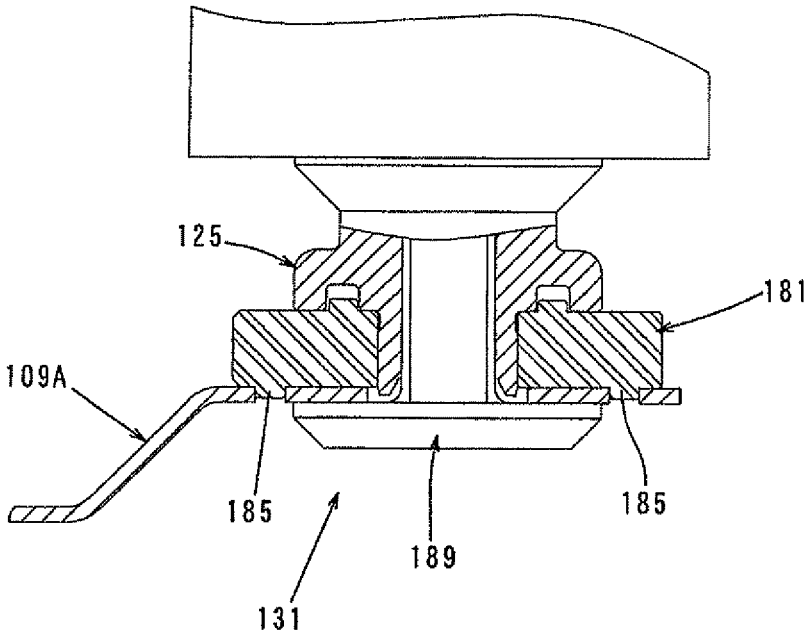
FIG. 26 is a sectional view showing the state in which the tool bit is clamped and held to the tool holder.
Figure 27:
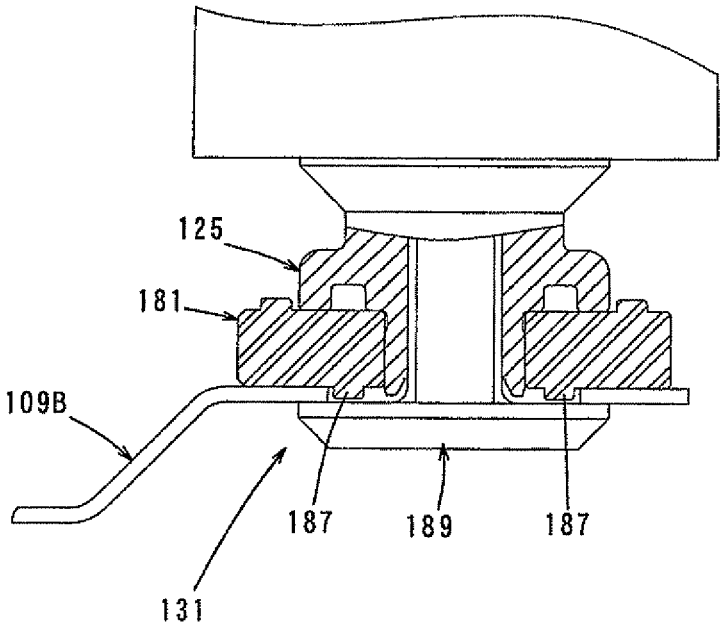
FIG. 27 is a sectional view showing the state in which the other tool bit is clamped and held to the tool holder.
Figure 28:
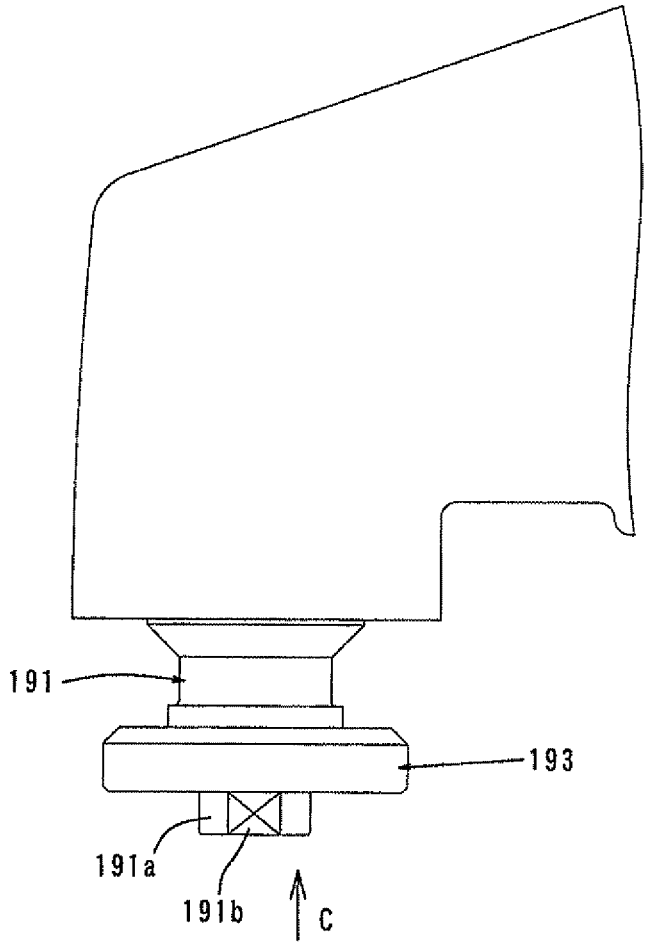
FIG. 28 is a side view showing a driving shaft and an inner flange member of a modification.
Figure 29:
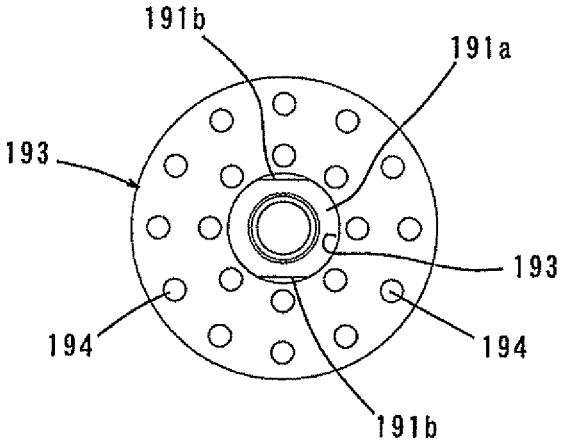
FIG. 29 is a view as viewed from a direction of an arrow C in FIG. 28.
Figure 30:
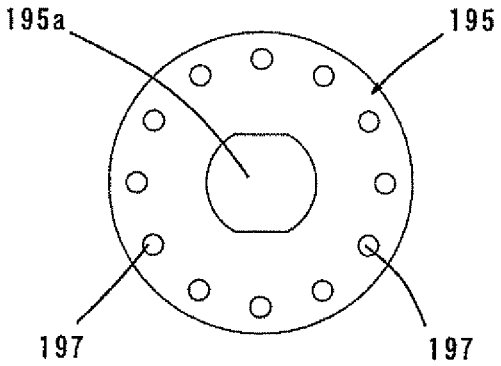
FIG. 30 is a plan view showing an outer flange member of the modification.
Figure 31:
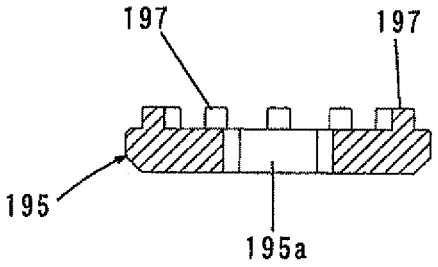
FIG. 31 is a sectional view showing the outer flange member.
Figure 32:
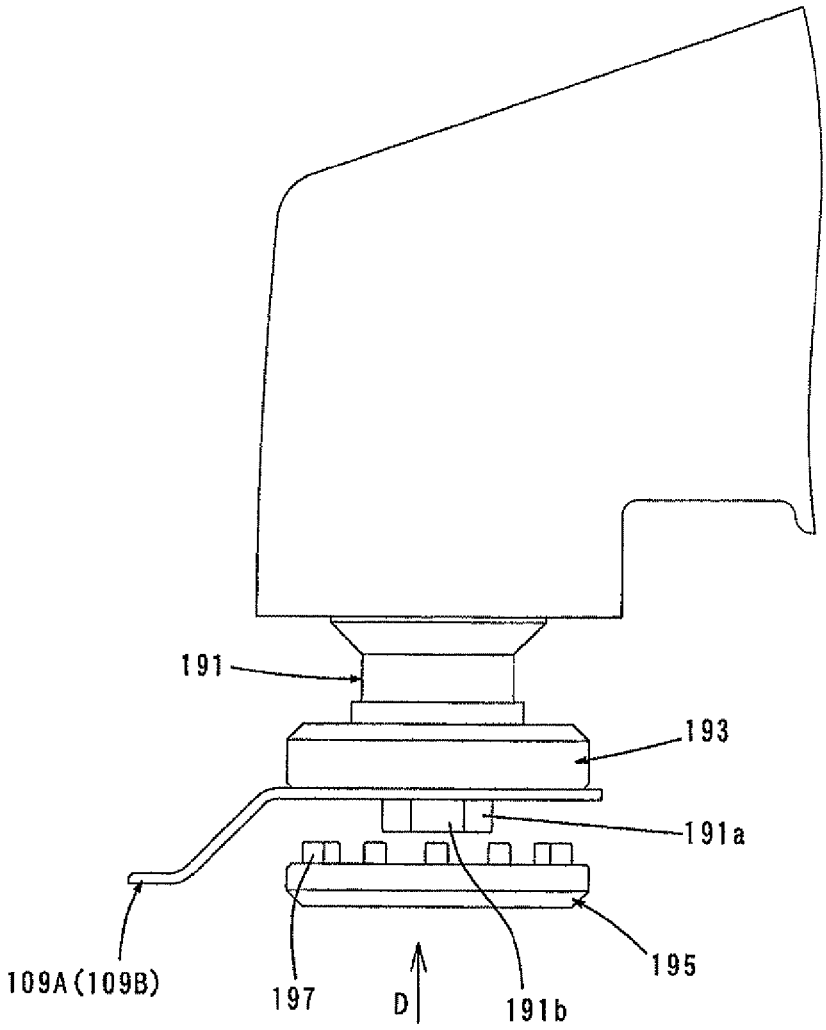
FIG. 32 is a side view illustrating clamping and holding in the modification.
Figure 33:
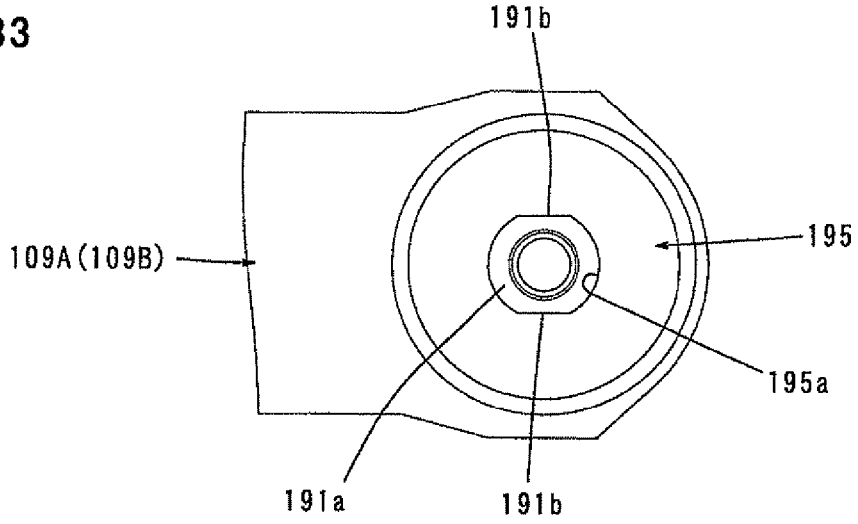
FIG. 33 is a view as viewed from a direction of an arrow D in FIG. 32.

According to the tool holder 131 of this embodiment which is constructed as described above, the first tool bit 109A and the second tool bit 109B can be selectively replaced with each other by reversing the inner flange member 181 so as to use either side for the selected tool bit. FIG. 26 shows the state in which the first tool bit 109A is clamped and held between the inner flange member 181 and the outer flange member 189, and FIG. 27 shows the state in which the second tool bit 109B is clamped and held therebetween.

When the first tool bit 109A is clamped and held, the engagement pins 185 which are provided on the front side of the inner flange member 181 and arranged in a radially outer region of the inner flange member 181 are inserted through the small holes 163 of the first tool bit 109A. Thus, the first tool bit 109A is securely fixed to the tool holder 131 such that it is prevented from moving in the circumferential direction with respect to the tool holder 131. Further, when the second tool bit 109B is clamped and held, the engagement pins 187 which are provided on the back side of the inner flange member 181 and arranged in a radially inner region of the inner flange member 181 are inserted through the cutout holes 167 of the second tool bit 109B. Thus, the second tool bit 109B is securely fixed to the tool holder 131 such that it is prevented from moving in the circumferential direction with respect to the tool holder 131.

According to this embodiment, with the construction in which the front and back sides of the inner flange member 181 having the engagement pins 185, 187 can be used by reversing, various kinds of the tool bits 109A, 109B which have holes varying in shape according to the kind of the tool bit can be selectively replaced with each other. Further, due to the construction in which the front and back sides of the outer flange member 171 can be used by reversing, like in the second embodiment, the inner flange member 181 is held attached to the body 103 side of the multi-tool 101 except for replacement, so that loss of the inner flange member 181 can be avoided.

Further, in this embodiment, in order to avoid the seating surface 125*c* of the driving shaft 125 from interfering with the engagement pins 185 or 187 which are not in use, the outer diameter of the seating surface 125*c* is determined such that the seating surface 125*c* is located inside a circle in which the engagement pins 185 for the first tool bit are arranged. Further, in order to avoid interference with the engagement pins 187 for the second tool bit, an escape recess 125*d* is formed in the seating surface 125*c*.

In the construction in which the engagement pins 149, 153, 175, 177 are formed on the outer flange member 135A, 135B, 171, when the engagement pins 149, 153, 175, 177 of the outer flange members 135A, 135B, 171 are inserted into the circular holes 143 or 145 of the inner flange member 133 through the small holes 163 or the cutout holes 167 of the tool bit 109A or 109B in order to clamp and fix the tool bit 109A or 109B, the circular holes 143 or 145 are not easily visible.

Therefore, in a modification shown in FIGS. 28 to 33, a mounting shaft part 191*a* is formed on a tip end of a driving shaft 191 and extends with a predetermined length through an inner flange member 193. The mounting shaft part 191*a* has a generally elliptical cross section having a width across bolt 191*b*. Further, correspondingly, an outer flange member 195 has a generally elliptical mounting hole 195*a*. Thus, the mounting hole 195*a* is fitted onto the mounting shaft part 191*a*, so that the inner flange member 193 and the outer flange member 195 are positioned in the circumferential direction.

Therefore, in order to fix the tool bit 109A or 109B to the tool holder 131, the user visually checks the relative position of the mounting hole 195*a* of the outer flange member 195 with respect to the mounting shaft part 191*a* of the driving shaft 191 in the circumferential direction through the mounting hole 195*a* and then fits the mounting hole 195*a* onto the mounting shaft part 191*a*. In this manner, the inner flange member 193 and the outer flange member 195 can be positioned in the circumferential direction. Therefore, the engagement pins 197 of the outer flange member 195 can be easily inserted into the circular holes 194 of the inner flange member 193 through small holes (not shown) of the tool bit 109A or 109B.

Further, the shapes of the holes formed in the tool bits 109A, 109B in the above-described embodiments are shown merely as an example, and their shape, arrangement and number may be appropriately changed as necessary, and correspondingly, the engagement pins and the circular holes for engagement with the engagement pins may also be changed.

Further, in this embodiment, the multi-tool 101 which performs a predetermined operation on a workpiece by reciprocating swinging movement of the tool bits 109A, 109B is explained as a representative example of the power tool, but the invention is not limited to the multi-tool 101. For example, it may be applied to a cutting tool which performs a cutting operation on a workpiece by rotation of the tool bit.

In view of the scope and spirit of the invention, the following features can be provided.

DESCRIPTION OF NUMERALS

101 multi-tool (power tool)
103 body
105 motor housing
107 mechanical housing
109 tool bit
109A first tool bit
109B second tool bit
111 driving motor
111*a* motor output shaft

113 motion converting mechanism
121 eccentric shaft
123 swing arm
124 engagement part
125 driving shaft
125*a* threaded hole
125*b* mounting shaft part
125*c* seating surface
125*d* escape recess
127 bearing
129 bearing
131 tool holder (tool holding part)
133 inner flange member (first clamping element)
135A, 135B outer flange member (second clamping element)
137 fixing screw
137*a* flange
141 mounting hole
143, 145 circular hole (fixing hole)
147 mounting hole
149 engagement pin (protruding engagement part) (projection)
151 mounting hole
153 engagement pin (protruding engagement part) (projection)
161 circular hole
163 small hole (fixing hole)
165 circular hole
167 cutout hole (fixing hole)
171 outer flange member (second clamping element)
173 mounting hole
175, 177 engagement pin (protruding engagement part) (projection)
179 fixing screw
179*a* flange
179*b* escape recess
181 inner flange member (first clamping element)
183 elliptical mounting hole
185, 187 engagement pin (protruding engagement part) (projection)
189 outer flange member (second clamping element)
191 driving shaft
191*a* mounting shaft part
191*b* width across bolt
193 inner flange member (first clamping element)
194 circular hole (fixing hole)
195 outer flange member (second clamping element)
195*a* mounting hole
197 engagement pin (protruding engagement part) (projection)

What we claim is:

1. A power tool system comprising:

a driving shaft for driving each of a first tool bit and a second tool bit, the first tool bit having a circular hole and a first group of holes, the first group of holes being arranged with equal spacing each other around an entire circular hole, each of the first group of holes being located at a predetermined first position, the second tool bit having a second group of holes, each of the second group of holes being located at a predetermined second position which is different from the first position, a first clamping element provided on the driving shaft, the first clamping element having i) a first engagement hole and ii) a second engagement hole, the first engagement hole having a predetermined first distance from a center of the first clamping element, the second engagement hole having a predetermined second distance from the center of the first clamping element, the predetermined second distance being different from the predetermined first distance, a second clamping element provided separately from the driving shaft, the first and second clamping elements are configured to clamp the first tool bit therebetween, and a third clamping element provided separately from the driven shaft, the first and third clamping elements are configured to clamp the second tool bit therebetween, wherein:

the second clamping element has a first protruding engagement part corresponding to the first group of holes and the first engagement hole, the third clamping element has a second protruding engagement part corresponding to the second group of holes and the second engagement hole, the first protruding engagement part and the second protruding engagement part are configured to engage with the first engagement hole and the second engagement hole formed on the first clamping element, respectively, and the first engagement hole and the second engagement hole are formed on a singular first clamping element.

2. The power tool system as defined in claim 1, wherein the first clamping element has i) a plurality of first engagement holes and ii) a plurality of second engagement holes, each of the plurality of first engagement holes having the predetermined first distance from the center of the first clamping element, each of the plurality of second engagement holes having the predetermined second distance from the center of the first clamping element, wherein:

the first protruding engagement part is configured to engage with the plurality of first engagement holes, and the second protruding engagement part is configured to engage with the plurality of second engagement holes.

3. The power tool system as defined in claim 1, wherein the second tool bit has a circular hole and the second group of holes, the second group of holes being arranged with equal spacing each other around an entire circular hole, each of the second group of holes being connected to the circular hole with a cutout hole and being located at the predetermined second position which is different from the first position.

* * * * *